US005678588A

United States Patent [19]

Perrott et al.

[11] Patent Number: 5,678,588

[45] Date of Patent: Oct. 21, 1997

[54] SEWER LINE MULTIPLE TRAP PRIMING SYSTEM AND METHOD

[75] Inventors: Charles H. Perrott; Frank W. Dowdican, both of Portland, Oreg.

[73] Assignee: C.H. Perrott, Inc., Portland, Oreg.

[21] Appl. No.: 582,364

[22] Filed: Jan. 5, 1996

[51] Int. Cl.[6] ..... E03C 1/296

[52] U.S. Cl. ..... 137/1; 137/118.05; 137/247.25; 137/624.11

[58] Field of Search ..... 137/1, 118.05, 137/118.06, 118.07, 247.25, 624.11, 624.12

[56] References Cited

U.S. PATENT DOCUMENTS

| | | | |
|---|---|---|---|
| 3,134,392 | 5/1964 | Goss | 137/118.05 |
| 3,333,597 | 8/1967 | Sullivan | 137/247.25 X |
| 3,776,269 | 12/1973 | Watts | 137/118.05 X |
| 4,497,337 | 2/1985 | Mosbrucker et al. | 137/247.25 |
| 4,589,435 | 5/1986 | Aldrich | 137/624.11 X |
| 4,942,896 | 7/1990 | Slusser | 137/360 |
| 5,253,670 | 10/1993 | Perrott | 137/247.25 |
| 5,441,070 | 8/1995 | Thompson | 137/624.11 X |

*Primary Examiner*—John Rivell
*Attorney, Agent, or Firm*—Eugene D. Farley

[57] ABSTRACT

A sewer line multiple trap priming system comprises a house line and a plurality of branch lines all communicating with each other and supplied with water under pressure. A plurality of makeup priming water lines are connected, one to each of the traps. In all but one of the branch lines pressure sensitive valves interconnect the branch lines and the makeup priming water lines. Upon a change in pressure in the branch lines by a predetermined increment, these valves are operable, to inject a charge of priming water into the priming water lines and hence into the traps. In said one of the branch lines, from time to time valve means withdraws water from the communicating branch lines in amount sufficient to exceed the pressure change increment and thereby operate the pressure sensitive valves. This insures the transmission of an adequate charge of priming water to the traps at all times.

7 Claims, 1 Drawing Sheet

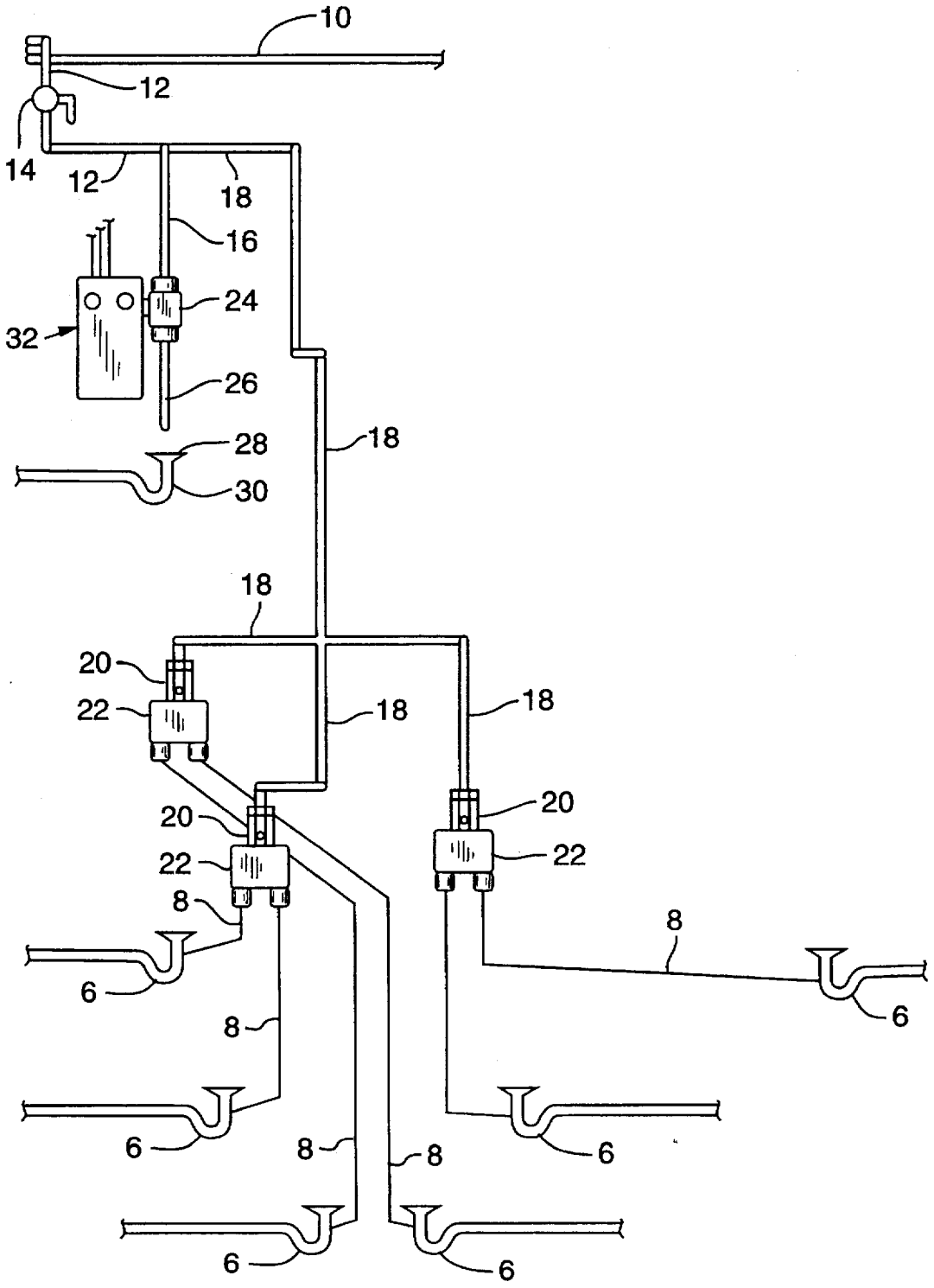
10
12
14
12
18
16
24
32
26
28
18
30
18
20
22
18
18
20
20
22
22
8
8
6
8
6
6
8
8
6
6

SEWER LINE MULTIPLE TRAP PRIMING SYSTEM AND METHOD

BACKGROUND OF THE INVENTION

1. Field of the Invention

This invention relates to a sewer line multiple trap priming system and to a method of priming such a system.

2. Description of the Prior Art

In modern plumbing practice it is commonplace to find a single apartment house, office building or supermarket in which there are dozens of sewer line drains associated with lavatories, laundry rooms, refrigerator display cases and the like. The sewer line traps associated with these drains must be kept operatively filled with water at all times. To overcome the effect of evaporation, this requires the addition of priming water to the traps at periodic intervals.

A makeup priming water valving system which is commonly employed in supplying priming water to such installations is responsive to changes in pressure occurring in the plumbing system. When a toilet is flushed, a faucet is opened, or a washing machine is actuated, the resulting withdrawal of water from the system results in a corresponding decrease in supply line pressure. The valves which supply makeup water to the traps are sensitive to this pressure change. When it occurs, a charge of water is transmitted to the associated traps.

A pressure sensitive valve suitable for this application is described in Watts U.S. Pat. No. 3,422,835 and, in modified form, in Perrott U.S. Pat. No. 5,263,508.

A problem associated with the operation of such a system, particularly in systems of vast extent including a multiplicity of sewer line traps, resides in the fact that the occasional withdrawal of water in minor amounts, perhaps by a single appliance, does not result in a pressure drop sufficient to energize the associated pressure sensitive valve. Accordingly, it is not at all assured that makeup water is supplied in the required amount at all times to the respective sewer line traps.

It is the general purpose of the present invention to overcome this problem and to provide a sewer line multiple trap priming system, preferably an automatic system, for insuring that the traps of the system are charged periodically with makeup water and are maintained full and operative at all times.

It is a further object of the invention to provide a method for accomplishing this result.

GENERAL STATEMENT OF THE INVENTION

The foregoing and other objects of the invention are accomplished by the provision of a sewer line multiple trap priming system which comprises a house line and a plurality of branch lines all communicating with each other and supplied with water under pressure. A plurality of makeup priming water lines, one connected to each of the traps is connected to all but one of the branch lines. In all but the latter one of the branch lines pressure sensitive valves are connected to the makeup priming water lines. These valves are operable upon changes by a predetermined increment in the branch line pressure. They operate to inject a charge of priming water into the priming water lines and hence into the traps.

In the branch line which does not connect to a pressure sensitive trap valve, means are supplied to withdraw water in amount sufficient to exceed the pressure change increment and thereby activate all of the pressure sensitive valves. This may be done automatically, and is done periodically as required to maintain the traps full and operable.

THE DRAWINGS

The single figure of the drawings is a schematic sketch of the herein described automatic sewer line multiple trap priming system.

DESCRIPTION OF A PREFERRED EMBODIMENT OF THE INVENTION

As shown schematically in the single figure of the drawings, it is the purpose of the present invention to insure that priming water is supplied to a plurality of sewer line traps 6 in amount and on a time schedule predetermined to insure that the traps are filled and maintained in an operative condition at all times. Each trap 6 is connected to, and served by, a makeup or priming water line 8. In a modern office building or apartment house complex there may be dozens or even hundreds of such traps in a complicated system of which the drawing is a simplified version and illustrative only.

Water under pressure is supplied to the sewer line trap system from a main line 10 into which a house line 12 with included throttle valve 14 is tapped. The purpose of the throttle valve is to regulate the flow of water into the system at a rate and under a pressure which is conducive to economical and efficient operation of the trap priming system.

House line 12 subdivides into a plurality of freely interconnecting branch lines 16, 18. Branch line 16 serves a particular function, as will appear hereinafter.

Each of branch lines 18 is connected to and serves a pressure sensitive water flow control valve 20. An example of such a valve is that disclosed in Watts U.S. Pat. No. 3,422,835, and Perrott U.S. Pat. No. 5,263,508 aforesaid. As noted, when valves of this class are connected to a pressurized fluid transmission line, in this case a pressurized water line, they funtion to open and transmit the conveyed fluid upon a change in pressure in the lines to which they are connected.

For reasons of economy (one priming valve 20 functions to serve a plurality of sewer line traps 6) there is included in the system one or more conventional manifolds or "distribution units" 22. These elements of the assembly subdivide the flow increment discharged by their associated pressure sensitive valves 20 into two or more portions. Each portion is conveyed by a separate primer line 8 to the associated sewer line trap.

Particularly in complex systems involving a large number of trap-priming units, a problem associated with the above described system resides in the fact that the appliance used does not reduce the pressure in the branch line system sufficiently to operate the pressure sensitive valves 20. As a consequence, an insufficient amount of makeup water may be supplied to traps 6.

Branch line 16 communicating with branch lines 18, is provided to overcome this problem. It feeds apparatus which at predetermined time intervals alters the pressure in line 16, and hence in the communicating branch lines 18, by an increment which without any doubt is sufficient to fire all of pressure sensitive valves 20.

The illustrated form of this apparatus comprises a valve 24 which draws water from line 16 and discharges it into a discharge pipe 26. The latter in turn discharges into its own sewer line floor drain 28 with associated trap 30.

To prevent siphoning of sewer line water from trap 30 into the house system, pipe 26 is separated from floor drain 28 by an appropriate distance, for example one inch. In the alternative, this gap may be bridged by any one of several conventional anti-siphoning devices which currently are on the market.

Valve 24 preferably comprises a valve of the disc and valve seat poppet type. It may be operated manually from time to time. Preferably, however, it is operated by a conventional electric solenoid the operation of which is controlled by means of a conventional time clock control 32.

OPERATION

The operation of the herein described sewer line multiple trap priming system is as follows.

After connection in the manner illustrated in the drawing, house line throttle valve is adjusted for regulating the pressure in branch lines 16, 18 to the level desired for most efficient and economical operation of the system. Solenoid operated valve 24 in branch line 16 is adjusted to discharge a predetermined amount of water through discharge line 26 in amount predetermined to reduce the pressure in branch lines 18 by an increment sufficient to insure operation of pressure sensitive valves 20.

Time clock 32, which is associated with solenoid-operated valve 24, is set at a desired time schedule.

During normal operation of the plumbing system, the operation of its included appliances reduces the pressure in branch lines 18 sufficiently to discharge adequate priming water via makeup water lines 8 into traps 6. However, if this should not be the case because of insufficient pressure reduction in lines 18, periodic operation of valve 24 will achieve the desired purpose. Accordingly, maintenance of the water level in sewer line trap 6 at the desired level is insured at all times.

Having thus described in detail a preferred embodiment of the present invention, it will be apparent to those skilled in the art that many changes may be made in the apparatus without altering the inventive concepts or principles embodied therein. The present embodiment is therefore to be considered in all respects as illustrative and not restrictive, the scope of the invention being indicated by the appended claims.

We claim:

1. A sewer line multiple trap priming system comprising:

a) a house line and a plurality of branch lines all communicating with each other and supplied with water under pressure, b) a plurality of makeup priming water lines, one connected to each of the traps, c) in all but one of the branch lines pressure sensitive valve means connected to the makeup priming water lines and operable upon a change in pressure in the branch lines by a predetermined increment to inject a charge of priming water into the priming water lines and hence into the traps, d) and, in said one branch line, valve means operable from time to time to withdraw water from the plurality of communicating branch lines in amount sufficient to exceed said pressure change increment and thereby actuate all of the pressure sensitive valves.

2. The sewer line multiple trap priming system of claim 1, including in the house line throttle valve means for establishing a predetermined working pressure in the branch lines.

3. The sewer line multiple trap priming system of claim 1 wherein the valve means in said one branch line comprises electric solenoid operated valve means.

4. The sewer line multiple trap priming system of claim 1 wherein the valve means in said one branch line comprises electric solenoid operated poppet valve means.

5. The sewer line multiple trap priming system of claim 1 wherein the valve means in said one branch line comprises time clock controlled, electric solenoid operated valve means.

6. The method of transmitting makeup priming water to a multiplicity of sewer line traps served by a common trap-priming system including and controlled by one or more pressure sensitive valves which are operable, upon a change in pressure in the system by a predetermined increment, to inject a charge of priming water into the traps; which comprises at predetermined time intervals altering the pressure in said system by an amount exceeding said increment, thereby insuring operation of the pressure sensitive valves, and accordingly the supply of an amount of priming water to the traps adequate to maintain them in a properly operative condition.

7. The method of claim 6, wherein the pressure in the system is altered by lowering the pressure.

* * * * *